US005896850A

United States Patent [19]

Sullivan, Jr.

[11] Patent Number: 5,896,850

[45] Date of Patent: Apr. 27, 1999

[54] PAINTBALL GUN WITH SIGHT RAIL COVER

[76] Inventor: Dennis G. Sullivan, Jr., 145 S. Rennell, San Dimas, Calif. 91733

[21] Appl. No.: 08/883,654

[22] Filed: Jun. 27, 1997

[51] Int. Cl.[6] ..... F41B 11/06

[52] U.S. Cl. ..... 124/74; 42/101; 89/1.4; 89/1.42

[58] Field of Search ..... 42/100, 101, 102; 89/1.4, 1.42; 124/69, 73, 74, 76

[56] References Cited

U.S. PATENT DOCUMENTS

| | | | |
|---|---|---|---|
| 904,646 | 11/1908 | Prinke | 42/100 |
| 3,651,736 | 3/1972 | Ingram | 89/132 |
| 4,827,652 | 5/1989 | Martin | 42/100 |
| 5,257,614 | 11/1993 | Sullivan | 124/73 |
| 5,341,790 | 8/1994 | Ebert | 124/73 |
| 5,634,456 | 6/1997 | Perrone | 124/76 |
| 5,704,342 | 1/1998 | Gibson et al. | 124/73 |

*Primary Examiner*—Stephen M. Johnson
*Attorney, Agent, or Firm*—Sheldon & Mak; Denton L. Anderson

[57] ABSTRACT

A Paintball Gun of the "cocking type" is provided wherein the cocking pin is covered by a sight rail cover which doubles as an aiming sight or as a platform for a scope. The cocking pin is retracted by use of a cocking link which is slidably disposed within the sight rail cover.

7 Claims, 3 Drawing Sheets

PAINTBALL GUN WITH SIGHT RAIL COVER

FIELD OF THE INVENTION

This invention relates generally to paintball guns, and specifically to paintball guns having a cocking mechanism.

BACKGROUND OF THE INVENTION

Paintball guns which pneumatically project a round projectile containing a gelatinous colored material have become enormously popular within the last fifteen years.

Most paintball guns presently sold on the market operate by providing a short burst of compressed gas behind a paintball in the gun's paint ball chamber (firing chamber) using a compressed gas valve which is opened by an impact device known as a "striker." When the trigger is pulled, the striker impacts an impact opener on the compressed gas valve, thereby causing the valve to open briefly and release a short burst of compressed gas into the paint ball chamber. The striker can be operated by purely mechanical means, for example by use of a coil spring, or by pneumatic means whereby the striker is energized by a portion of the compressed gas.

In almost all paintball guns of this type, operation of the gun is initiated by "cocking" the striker by use of a manual cocking pin. The cocking pin draws the striker away from the impact opener on the compressed gas valve against the biasing pressure of a coil spring and the cocking pin and/or striker is latched in that position, ready for activating the firing mechanism. When the trigger is pulled, the latching mechanism is released, allowing the striker to impact the impact opener on the compressed gas. This causes the valve to release a burst of compressed gas into the paint ball chamber, thereby propelling a first paintball down the barrel of the gun. The striker is then retracted to the cocking position, either manually (by again use of the cocking pin) or pneumatically (by use of a portion of the compressed gas).

The cocking pin is generally disposed in an elongated slot in the body of the gun. This slot is generally open to the air. Several problems arise from this configuration. First, the exposed slot allows dirt and grime to enter the body of the gun. This is an important problem because most paintball gun tournaments are conducted outdoors. Second, the exposed cocking pin can easily be inadvertently bumped or jarred, thereby causing the gun to misfire.

Accordingly, there is a need for a paintball gun which simply and inexpensively eliminates these problems associated with the exposed cocking pin and slot.

SUMMARY OF THE INVENTION

The invention satisfies this need. The invention is a paintball gun of the "cocking type" having a cocking pin disposed within an elongated slot, the improvement comprising the installation of the cocking pin and elongated slot on the top of the gun and covering the cocking pin and elongated slot with a sight rail cover. The sight rail cover can have a smooth flat top surface so that the sight rail can be used as an aiming sight in the operation of the gun. A cocking link is slidably disposed within the sight rail cover, but protruding out the rear end of the sight rail cover. At the rearward end of the cocking link is disposed a cocking knob. At the forward end of the cocking link is an elongated slot, sized and dimensioned to slip over the cocking pin so as to engage the cocking pin and allow the cocking link to draw the cocking pin rearwardly, so as to cock the gun, by pulling rearwardly on the cocking knob.

DESCRIPTION OF THE DRAWINGS

These and other features, aspects and advantages of the present invention will become better understood with reference to the following description, appended claims and accompanying drawings where:

FIG. 4 is a side view in partial cross-section of a paint ball gun of the prior art.

"FIG. 5 is an enlarged view of a portion of prior art FIG. 4."

DETAILED DESCRIPTION OF THE INVENTION

Figure 1:
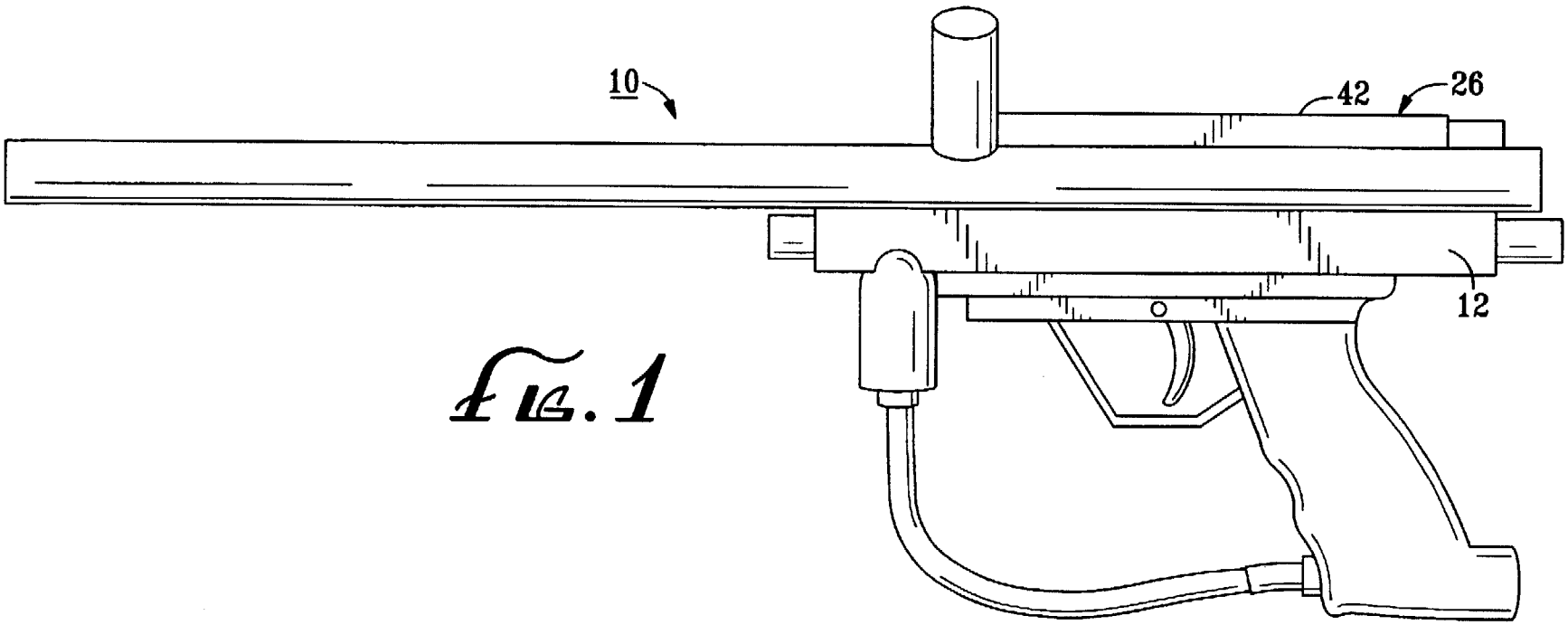
FIG. 1 is a side view of a paint ball gun having features of the invention.
Figure 2:
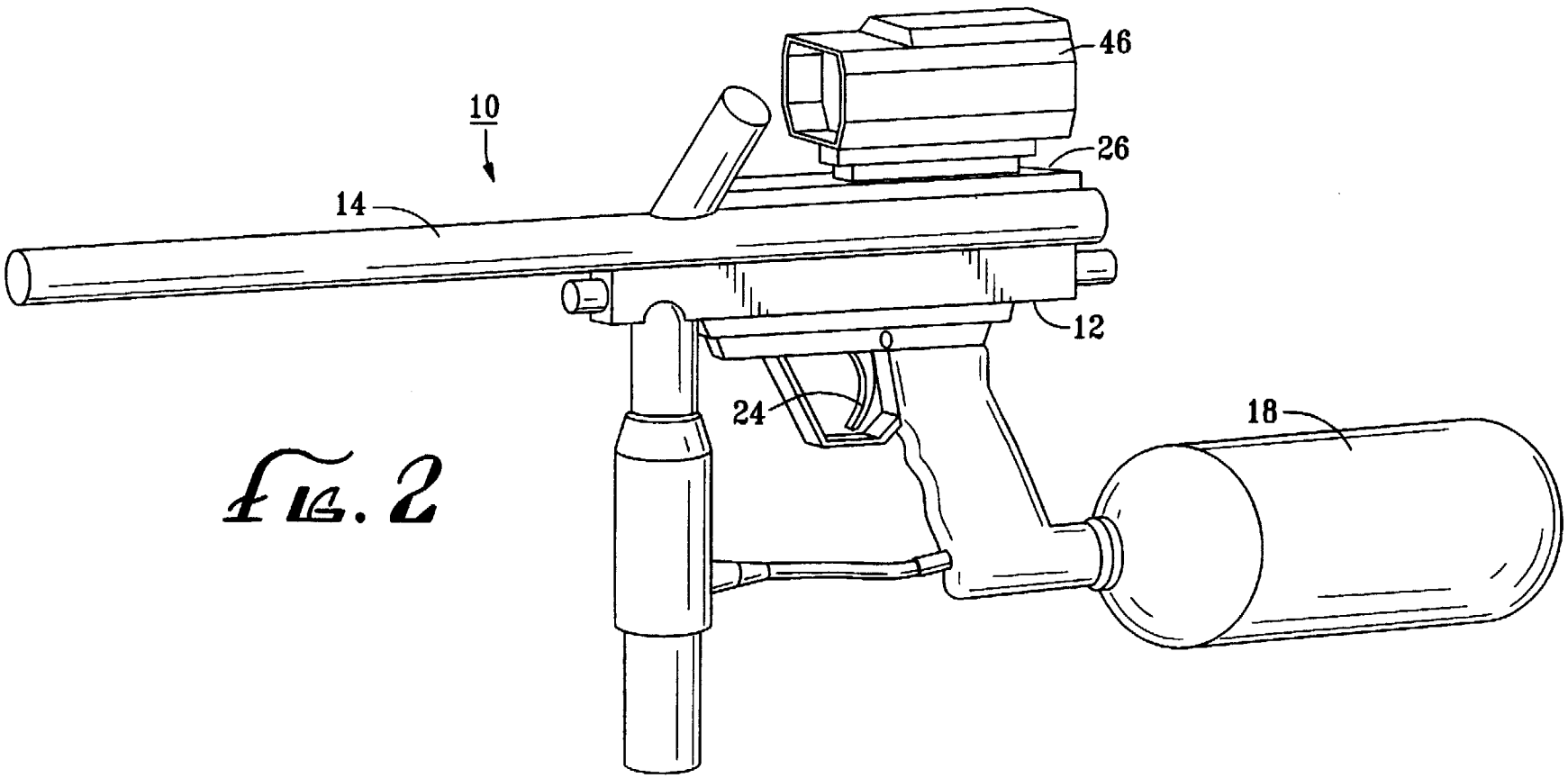
FIG. 2 is a perspective view of a second paint ball gun having features of the invention.

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

The invention is an improvement in a paint ball gun 10 of the "cocking type," as illustrated in FIG. 4. By "cocking type," it is meant that the paintball gun 10 has a body 12, a barrel 14, a paintball chamber 50, a compressed gas cylinder 18 and a gas valve 52 which is opened by the impact of a movable striker 54 against an impact opener 56. The moveable striker 54 is biased to impact the impact opener 56 by a biasing means 58, such as a coil spring. The striker 54 can be manually retracted away from the gas valve 52 by movement of a cocking pin 20 attached to the striker 54 and slidably disposed within an elongated slot 22 in the body 12.

In a paintball gun 10 of the "cocking type," once the striker 54 is retracted to the cocked position, the striker 54 is latched into place by a releasable cocking latch 62. A trigger 24 is operatively connected to the releasable cocking latch 62 so that, when the trigger 24 is pulled, the releasable cocking latch 62 is released and the striker 54 is caused to impact the impact opener 56 on the gas valve 52, thereby briefly opening the gas valve 52 to allow a burst of compressed gas to flow from the compressed gas cylinder 18 into the paintball chamber 50.

In a sophisticated version of such paintball gun 10—called a "blow type gun"—a portion of the compressed gas released by the gas valve is used to re-cock the striker. This provides a semi-automatic gun which can be repeatedly fired by repeatedly squeezing the trigger 24. However, in such sophisticated paintball guns, such as "blow type" guns, the gun 10 must generally be initially operated by manually cocking the striker.

The invention is an improvement to such cocking type paintball guns 10, wherein the cocking pin 20 and the elongated slot 22 in the body 12 is located at the top of the gun 10 and the cocking pin 20 and the elongated slot 22 are covered with a sight rail cover 26.

Figure 3:
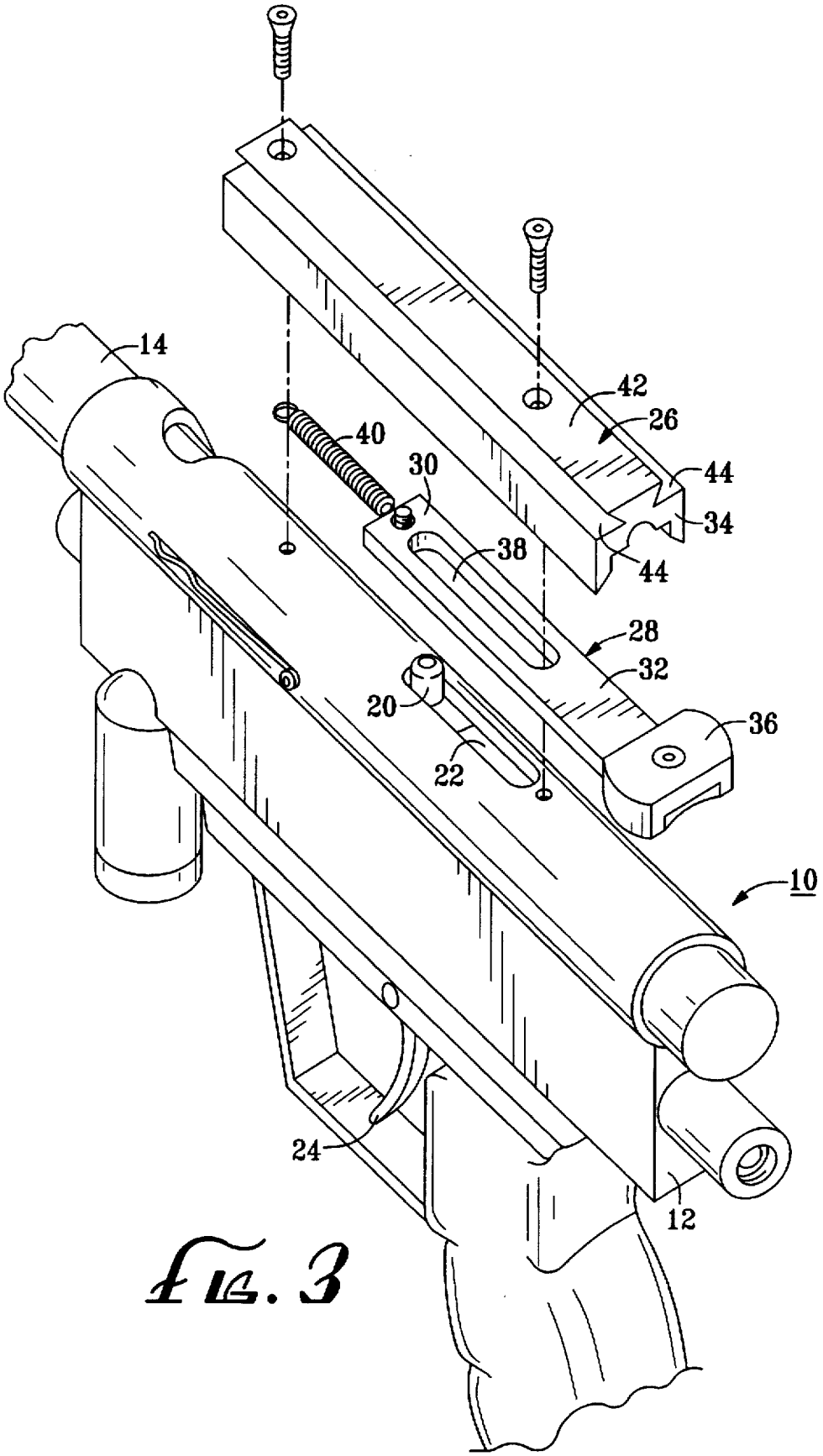
FIG. 3 is a perspective detail view of a paint ball gun having features of the invention.

As best illustrated in FIG. 3, the sight rail cover 26 can be a generally U-shaped element. The sight rail cover 26 can be made from any suitable rigid material, such as plastic or metal. In a typical embodiment, the sight rail cover 26 is made from an extruded aluminum.

The sight rail cover 26 is typically screwed into place over the cocking pin 20 and the elongated slot 22 in the body 12 so as to minimize the amount of dirt and grime entering the paintball gun 10 via the elongated slot 22 and to minimize misfiring of the gun 10 by inadvertent bumping of the cocking pin 20.

Slidably disposed within the sight rail cover 26 is a cocking link 28 having a forward end 30 and a rearward end 32. The rearward end 32 protrudes out of the rearward end 34 of the sight rail cover 26. At the rearward end 32 of the cocking link 28, a cocking knob 36 is disposed which facilitates the gripping of the rearward end 32 of the cocking link 28. Preferably, the cocking knob 36 is knurled to facilitate its gripping by the thumb and forefinger of the user.

At the forward end 30 of the cocking link 28, the cocking link 28 has an elongated cocking link slot 38 which is preferably about the same length as the elongated slot 22 in the body 12 (in which the cocking pin 20 is disposed). The elongated cocking link slot 38 is sized and dimensioned to surround the cocking pin 20 such that, when the gun 10 is fully assembled, the cocking link 28 can be drawn rearwardly by manually pulling the cocking knob 36 rearwardly.

Preferably the cocking link 28 is biased to slide forward in the sight rail cover 26 by a cocking link spring 40. The cocking link spring 40 tends to bias the cocking link 28 forward into the sight rail cover 26 when the cocking link 28 is not in use so that the cocking knob 36 covers the rearward end 34 of the sight rail cover 26 to minimize dirt and grime getting into the gun 10 from this location.

In one embodiment, the sight rail cover 26 has a smooth, flat top surface 42, so that the sight rail cover 26 can be used as an aiming sight for aiming the gun 10.

In a preferred embodiment, the sight rail cover 26 further comprises attachment sites, such as opposed external grooves 44, to facilitate the attachment of a scope 46, such as a telescope, a point dot scope or a laser-assisted scope.

The invention provides a simple and inexpensive means for avoiding the problems with cocking type paintball guns of the prior art.

What is claimed is:

1. In a paint ball gun of the type having: a body, a barrel attached to the body, a paint ball chamber disposed within the body and aligned with the barrel, a compressed gas cylinder attached in fluid tight communication to the paint ball chamber, a trigger attached to the body, a gas valve disposed within the body for alternatively allowing and preventing the flow of compressed gas from the compressed gas cylinder to the paint ball chambers the gas valve including an impact opener which opens briefly to allow a short burst of compressed gas to flow from the compressed gas cylinder to the paint ball chamber when the impact opener is impacted, a striker movably disposed within the body for alternatively moving between a first striker position wherein the striker is in contact with the impact opener of the compressed valve and a second striker position wherein the striker is not in contact with the impact opener, biasing means for biasing the striker to the first striker position, the biasing means being of sufficient strength to cause the striker to impact the impact opener when the striker is biased from the second striker position to the first striker position so as to open the compressed gas valve, and cocking means, including a cocking pin disposed within an elongated slot in the body and a releasable cocking latch, for manually moving the cocking pin from a first cocking pin position wherein the striker is in the first striker position and a second cocking position wherein the striker is in the second striker position and is latched thereat with the cocking latch, and a trigger connection mechanism for releasing the striker from the cocking latch when the trigger is pulled, the improvement comprising (a) a sight rail cover disposed over the cocking pin and the elongated slot wherein is disposed the cocking pin; and (b) a cocking link slidably disposed within the sight rail, the cocking link being attached to the cocking pin, the cocking link having a forward end and a rearward end with the rearward end protruding rearwardly of the sight rail cover, so that the cocking pin can be moved from the first cocking pin position to the second cocking pin position by pulling on the cocking link.

2. The paintball gun of claim 1 wherein the sight rail cover is disposed on the top of the body and wherein the sight rail cover has a smooth flat top surface, so that the sight rail cover can be used as an aiming sight.

3. The paintball gun of claim 1 further comprising a cocking knob disposed at the rearward end of the cocking link.

4. The paintball gun of claim 3 wherein the cocking knob is knurled to facilitate gripping.

5. The paintball gun of claim 1 wherein the cocking link is attached to the cocking pin by an elongated cocking link slot disposed within the cocking link.

6. The paintball gun of claim 5 wherein the cocking link slot is substantially the same length as the elongated slot in the body wherein is disposed the cocking pin.

7. The paintball gun of claim 1 further comprising a scope attached to the sight rail cover.

* * * * *